US005249502A

United States Patent [19]

Radocaj

[11] Patent Number: 5,249,502

[45] Date of Patent: Oct. 5, 1993

[54] DOUBLE ACTION, DUAL SPEED AND FORCE HYDRAULIC ACTUATORS

[76] Inventor: Mijo Radocaj, 1912 Amherst Rd., NE., Massillon, Ohio 44646

[21] Appl. No.: 819,843

[22] Filed: Jan. 13, 1992

[51] Int. Cl.[5] ..... F01B 7/20; F15B 11/00; F15B 13/00

[52] U.S. Cl. ..... 91/173; 91/176; 91/519; 91/520; 91/535; 91/422; 91/432; 92/61; 92/151

[58] Field of Search ..... 91/156, 168, 170 R, 91/173, 176, 508, 519, 520, 535, 419, 422, 432, 167 R, 160; 92/61, 66, 151; 60/581

[56] References Cited

U.S. PATENT DOCUMENTS

| | | | |
|---|---|---|---|
| 2,820,347 | 1/1958 | Highland et al. . | |
| 3,186,309 | 6/1965 | Killebrew . | |
| 3,602,098 | 8/1971 | Balkee | 91/519 |
| 3,974,990 | 8/1976 | Holt et al. | 91/519 X |
| 4,144,904 | 3/1979 | Dits | 60/581 X |
| 4,443,179 | 4/1984 | Wohlrab | 91/519 X |
| 4,496,033 | 1/1985 | Hall et al. | 188/347 |
| 4,523,512 | 6/1985 | Hessel et al. | 91/173 X |
| 4,861,259 | 8/1989 | Takada | 425/451.2 |

FOREIGN PATENT DOCUMENTS

| | | | |
|---|---|---|---|
| 40904 | 3/1887 | Fed. Rep. of Germany | 91/519 |
| 421079 | 11/1925 | Fed. Rep. of Germany | 91/519 |
| 1964076 | 8/1977 | Fed. Rep. of Germany | 91/173 |
| 138236 | 10/1979 | Fed. Rep. of Germany | 91/173 |
| 163707 | 10/1982 | Japan | 91/173 |
| 1441845 | 7/1976 | United Kingdom | 91/173 |

*Primary Examiner*—Edward K. Look
*Assistant Examiner*—John Ryznic
*Attorney, Agent, or Firm*—Paul E. Milliken; Lee A. Germain

[57] ABSTRACT

A hydraulic fluid Pressure-operated actuator comprises a first cylinder assembly having an output which operatively carries a second cylinder assembly such that an axial output force is effected from an output shaft of the second cylinder assembly, the output from the second cylinder assembly is a fast forward output stroke which is followed by a greatly increased high pressure force generated by the first cylinder assembly and effected through the output shaft of the second cylinder assembly.

15 Claims, 3 Drawing Sheets

DOUBLE ACTION, DUAL SPEED AND FORCE HYDRAULIC ACTUATORS

FIELD OF THE INVENTION

The present invention pertains generally to hydraulic actuation wherein a hydraulic fluid-operated mechanism provides an output force which is used to operate a second device, machine, or mechanism.

More particularly, the present invention pertains to a multiple-stage, double-acting, hydraulic fluid actuator which provides an initial fast forward output stroke followed by a high force output stroke while pumping and returning a minimum volume of hydraulic fluid such that the number of operational cycles of the actuator are increased.

BACKGROUND OF THE INVENTION

Multiple stage hydraulic fluid systems have been known and practiced in various of the arts for a long time. Such type systems provide variable outputs from a single mechanism and a primary application for such systems pertains to the injection molding art. In the injection molding process it is desirous to provide a fast-action closure of a mold and then to maintain the mold closure under a high pressure force during the injection molding cycle. Such systems are found and disclosed in U.S. Pat. Nos. 4,443,179 to Wohlrab and 4,861,259 to Takada.

Other applications for multiple stage actuation involve material handling machines which require dual speed lifting arms as disclosed in U.S. Pat. No. 3,186,309 to Killebrew and to various type presses requiring reciprocating action as disclosed in U.S. Pat. No. 3,602,098 to Balkee.

Further, these type multiple stare systems have been applied to various brake applications as exemplified in U.S. Pat. Nos. 4,496,033 to Hall et al and 2,820347 to Highland et al. The Highland et al mechanism is configured to change the hydraulic fluid pressure from an initial low pressure to a final high pressure such as to effect operation of a brake device.

The present invention may be applied to many and various applications including those mentioned above and it is in accordance with a primary aspect thereof to provide a hydraulic fluid actuator which accomplishes a fast forward output stroke followed by a high pressure output force such as to maintain position of the output during a particular machine operation while pumping and returning a relatively low volume of hydraulic fluid.

In accordance with another aspect of the present invention it is an object to provide a hydraulic fluid-operated actuator which is dual speed and double acting such as to increase the number of actuator cycles in a particular period of time.

According to still another aspect of the present invention it is an object to provide a hydraulic actuator which is simple in design and easily controlled and which may be operated in various mounting configurations to accomplish an initial fast forward output stroke followed by a greatly increased output force.

According to another aspect of the present invention it is an object to provide an actuator which may be operated using various arrangements of hydraulic fluid pumps, valves, and reservoirs to accomplish an initial fast forward output stroke followed by a high pressure output force and then a fast reverse stroke to complete an actuator operation cycle in the shortest period of time while pumping and returning a minimum volume of hydraulic fluid.

SUMMARY OF THE INVENTION

A hydraulic fluid pressure actuator provides a fast forward and relatively long output stroke followed by a greatly increased pressure force and this is accomplished in a first hydraulic cylinder assembly having an output shaft which operatively carries a second hydraulic cylinder assembly such that an axial output force is effected from an output shalt of the second assembly, the second assembly providing a fast forward output stroke as may be established by a selective pressurization of pressure chambers associated with the second assembly which is followed by an increased pressure force as may be effected by a selective pressurization of pressure chambers associated with the first assembly, the increased pressure force acting through the output shaft of the second assembly.

BRIEF DESCRIPTION OF THE DRAWINGS

The various features and advantages of the present invention will become apparent and appreciated from a consideration of the following detailed description when taken in conjunction with the accompanying drawings in the several figures in which like-reference numerals and/or letters may be used to identify like elements and/or directions of actuator operation and wherein.

DETAILED DESCRIPTION OF THE PREFERRED EMBODIMENTS

Figure 1:
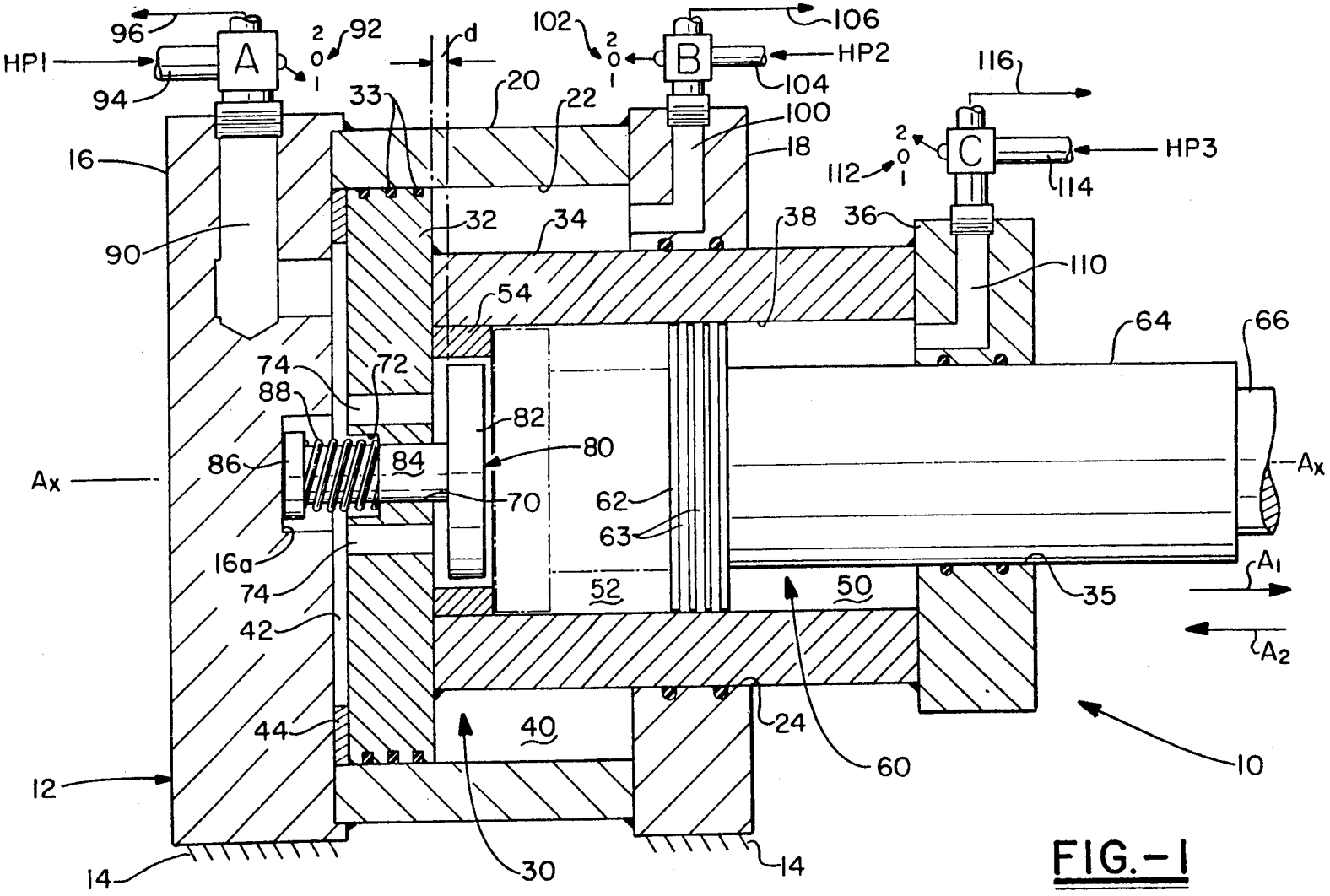
FIG. 1 is an elevational view, in partial cross-section, of a hydraulic actuator in accordance with a first embodiment of the invention.

Referring to FIG. 1 of the drawings, reference numeral 10 generally indicates a hydraulic actuator in accordance with a first embodiment of the invention wherein a housing 12 is mounted at 14 such as to be relatively stationary with reference to an output end which is to the right in the drawing at reference numeral 66. In this respect, it should be pointed out that the actuator 10 may be mounted to any type of device, machine, or mechanism and that the mounted condition of the housing 12 will be considered stationary with respect to its output end 66 irrespective of whether or not the particular device, machine or mechanism is moving or stationary. In this respect also, it will be apparent that either end of the actuator 10 may be rendered stationary such that the opposite end becomes the dedicated movable element. For example, the end 66 may be mounted stationary with respect to the housing 12 which is then the movable member of the actuator 10. In any event, the actuator housing 12 is configured to carry a pair of relatively movable hydraulic cylinder assemblies which are generally indicated at reference numerals 30 and 60 respectively. The assemblies 30,60 are mounted coaxially with respect to the housing 12 along a longitudinal axis indicated at Ax—Ax in the drawing.

The housing 12 is comprised of an input end member 16 and an output end member 18 and these are interconnected by a middle shaft or cylinder member 20 which defines a bore 22. The bore 22 is adapted for receiving a piston 32 of the assembly 30 in a working fit relationship such that the assembly exhibits reciprocal motion within the bore 22 along the Ax axis. The end member 18 has an axial bore 24 through which the assembly 30 passes in a sliding relationship and it also provides an end stop for the assembly 30 should it traverse the full length of the bore 22.

The cylinder assembly 30 comprises a piston head 32 in sealed engagement within the bore 22 via a plurality of seal rings 33 in a conventional manner and it is connected to an end member 36 through a longitudinally extending middle shaft or cylinder member 34. The member 34 defines a bore 38 which is adapted for receiving a piston head 62 of the assembly 60 in a working fit relationship such that the assembly 60 exhibits reciprocal motion within the bore 38 along the Ax axis. The end member 36 has an axial bore 35 through which the assembly 60 may pass in a sliding relationship and it also provides an end stop for the assembly 60 should it traverse the full length of the bore 38.

The hydraulic cylinder assembly 60 comprises a piston head 62 which is in sealed engagement within the bore 38 via a plurality of seal rings 63 in a conventional manner and it is connected to an output member 66 through a middle longitudinally extending shaft member 64 which passes through the bore 35 in the end member 36 of the assembly 30, It will, of course, be recognized that either of the shaft members 64 or 66 may be affixed to a device, machine, or mechanism (not shown) which benefits from the output action of the actuator 10 and, therefore, the invention is not considered limited by the manner or type of such output connection.

It should be evident from the above description and the drawing that, the diameter relationships as between the housing bore 22 and the cylinder 34 of assembly 30 is such as to define a forward pressure chamber 40 and a rearward pressure chamber 42 with respect to the piston 32 when the actuator 10 operates from left-to-right as shown in the figure. Of course, when the actuator operates alternatively such that the output end is the member 12 then the forward pressure chamber will be at 42 and the rearward chamber at 40. In a similar manner, the diameter relationship as between the bore 38 of the assembly 30 and the shaft member 64 of assembly 60 is such as to define a forward pressure chamber 50 and a rearward pressure chamber 52 with respect to the piston 62. The alternative pressure chamber designations will also apply when the output of the actuator is the member 12 as indicated above. The pressure chambers 40,42,50,52 are, of course, the operational hydraulic fluid pressure chambers for the actuator 10 and this will become apparent as the description proceeds.

An annular seat 44 may be provided within the rearward end of the pressure chamber 42 for engagement with the piston 32 when the assembly 30 is in the full rearward position as illustrated in the drawing. In similar manner, an annular seat 54 may be provided within the rearward end of the pressure chamber 52 for engagement with the piston 62 when the assembly 60 is in the full rearward position as illustrated by the dot-dashed ghost lines in the drawing. The annular seats 44 and 54 have functional purposes which will be described with respect to a cheek valve assembly generally indicated at reference numeral 80 in the drawing.

The check valve assembly 80 comprises a valve disk 82 which is connected to a valve stop 86 through a stem 84 which passes through an axial bore 70 in the piston head 32. The bore 70 has a larger diameter bore portion 72 at the rearward end of the piston and it carries a compression spring 88 in seated engagement between it and the end stop 86. The spring 88 functions to move the valve disk 82 into engagement with the forward end surface of the piston 32 such as to close off a plurality of axial bores or fluid passages 74 which are in spaced-apart orientation about the bore 70. In the rearward position of the assembly 30, the check valve stop 86 makes contacting engagement with the actuator housing member 16 such as to compress the spring 88. A recess **16*a* may be cut into the end member 16 and it can be appreciated that the annular seat 44 functions to establish a clearance distance which the valve seat 82 has with respect to the frontal end surface of the piston 32. The clearance distance is indicated at reference "d", in the drawing and it is a function of the hydraulic fluid requirement which must pass through the check valve 80 in the operation of the actuator 10. In a similar manner, the annular seat 54 is dimensioned in axial thickness to provide a clearance at the rearward end of the piston 62, i.e., between its backside surface and the frontal surface of the valve disk 82 when the check valve 80 is in the open position shown. Clearly, hydraulic fluid may pass through the check valve 80 and fluid pressure applied to the rearward surface area of the piston 62 when the assembly 30 is in the rearward home position at the annular seat 44**.

It will, of course, be apparent and it is anticipated that the annular seats 44 and 54 may be separate seating rings or they may be made as annular portions of either piston 32 or the end member 16. For example, the annular seat 44 may be part and parcel of the piston 32 while the annular seat 54 may be formed as part and parcel of the cylinder member 34 or made as part of the piston 62. In any configuration, the annular seats 44 and 54 function to create a particular gap or clearance distance "d" such that a predetermined volume of hydraulic fluid passes through the check valve 80 when the assembly 30 is in the home seated position shown in the drawing.

In the operation of the actuator 10, hydraulic fluid pressure is introduced into the pressure chambers 40, 42, 50, and 52 by way of a plurality of valves which are schematically illustrated at references A, B, and C in the drawing. For the purposes of this description, each of the valves A–C may have operational positions: (i) a "1" position for the introduction of hydraulic fluid pressure into the actuator 10, (ii) a "2" position for exhausting hydraulic fluid pressure out of the actuator 10, and (iii) a "0" position for blocking any fluid passage through the valve in any direction. Thus, and with reference to valve A, a hydraulic fluid pressure HP1 may be introduced into the actuator 10 via a conduit or fluid passage 90 in the end member 16 of the housing 12. The fluid passage 90 connects into pressure chamber 42 which also connects into pressure chamber 52 via the check valve 80 when it is in the open position shown in the drawing. The hydraulic fluid pressure HP1 is fed into valve A via a feed line 94 which comes from a source of such hydraulic fluid pressure (not shown) which conventionally comprises a suitable pump or the like.

With reference to valve B, a hydraulic fluid pressure HP2 may be introduced into the actuator 10 via a conduit or fluid passage 100 in the end member 18 of housing 12 and it connects into pressure chamber 40. The hydraulic fluid pressure HP2 is fed into valve B via a feed line 104 which comes from a source of such hydraulic fluid pressure (not shown) and it may or may not be the same source which supplies the hydraulic fluid pressure HP1.

With reference to valve C, a hydraulic fluid pressure HP3 is fed into valve C via a feed line 114 which comes from a source of such hydraulic fluid pressure (not shown) and, again, such source may or may not be the same source which supplies hydraulic fluid pressures HP1 and HP2 to valves A and B. In this respect also, the valves A–C have fluid pressure relief or exhaust ports 96, 106, and 116 respectively which are connected to suitable sumps or reservoir in a well-known and understood manner. Obviously, the reservoirs may be separate when the sources of hydraulic fluid pressure HP1, HP2, and HP3 are separate or alternatively, a common reservoir or sump may be used. Whether the sources of such hydraulic fluid pressure are separate or common will depend upon the complexity of the controls one wishes to apply to the operation of the actuator 10 and this is considered to be within the knowledge and skill of persons working in this art. This invention, therefore, is not limited to a particular manner of controlling the valves A–C or the number or type of sources of hydraulic fluid pressure. Further, the valve positions for valves A–C as indicated at reference numerals 92, 102, and 112 respectively are for the sole purpose of this description and are not intended to specify a particular valve configuration model, or type.

It will be recognized that the hydraulic actuator 10 comprises a double-acting mechanism in that hydraulic fluid pressure is used to provide both the output force necessary for work output and that which is necessary for a reverse motion to complete a cycle of the actuator. Further, it will be understood that the actuator comprises a closed system in that fluid pressure which provides the output force is an addition to the hydraulic fluid already present within the operational pressure chambers of the actuator. In a same manner, a reverse operation of the actuator 10 comprises a depletion of hydraulic fluid pressure in various of the pressure chambers coupled with an addition of hydraulic fluid pressure in others of the pressure chambers. In other words, hydraulic fluid is never completely evacuated from the actuator but only added and/or subtracted from the fluid volume already present to accomplish both the forward and reverse motions of the actuator.

In the operation of the actuator 10, it will be assumed that the cylinder assemblies 30 and 60 initiate action from a home position which at the left in the drawing and that a work output force is exerted to the right, i.e., in the direction of arrow A1. Of course, the reverse action or motion will be to the left in the direction of arrow A2. It should also be pointed out that an output stroke of either piston 32 or 62 need not require that either piston traverse the full axial extent of its respective bore 22 or 38 but that the output stroke length will be determined by the requirements of the device, machine, or mechanism which accepts the output stroke via the output shaft 66.

To begin operation, valve A is put in the "1" position to accept a hydraulic fluid pressure HP1, valve B is put in the closed "0" position to block any fluid passage through the valve, and valve C is put in the "2" position to exhaust fluid pressure. Hydraulic fluid pressure HP1 enters the actuator 10 through fluid passage 90 and into pressure chamber 42, passes through the check valve 80 via fluid passages 74 and into pressure chamber 52 to exert a relatively high force on piston 62 which moves assembly 60 to the right in the direction of arrow A1. This is a fast forward stroke of the assembly 60 due to the substantially high hydraulic fluid pressure passing through the passage 90 and the relative size of the piston head 62. Hydraulic fluid pressure within the pressure chamber 50 is forced out thru valve C for return to a reservoir or sump and assembly 30 is restrained from any motion by the closure of valve B which traps incompressible hydraulic fluid in the pressure chamber 40. Upon the assembly 60 reaching the desired stroke length limit or a required output force, valve C is switched to the "0" closed position, valve B is switched to the "2" position for exhausting fluid pressure, and valve A continues to supply hydraulic fluid pressure HP1 to pressure chambers 42 and 52. The open position of valve B and the pressence of pressure HP1 moves assembly 30 to the right in the direction of arrow A1 and as piston 32 moves through the distance "d", check valve 80 is closed by the action of compression spring 88. The assembly 60 moves to the right along with assembly 30 due to the closure of check valve 80 and the presence of incompressible hydraulic fluid in pressure chamber 52. The output force is thus multiplied by the increased surface area of piston 32 and it will be appreciated that, for a small increase in the volume of hydraulic fluid pressure due to HP1, a very large output force may be realized at shaft 66.

A reverse action of the actuator 10 is accomplished by moving valve A to position "2" for exhausting hydraulic fluid pressure and switching valves B and C to the "1" positions such that hydraulic fluid pressures HP2 and HP3 may pressurize the chambers 40 and 50 respectively. This functions to move the combined assemblies 30 and 60 to the left in the direction of arrow A2. It will be recognized that the assembly 60 will not move relatively within the bore 38 due to the closed condition of check valve 80 and this will aid in returning assembly 30 back to the home position at annular seat 44. Upon passing through the clearance distance "d", the check valve 80 is forced to the open position by a compression of spring 88 as the valve stop 86 reaches its limit of travel at housing member 16, and hydraulic fluid pressure HP3 continues to effect a reverse motion of assembly 60 in the direction of arrow A2. 14hen assembly 60 reaches its home position at annular seat 54, the actuator cycle is completed and another new cylce may be started by changing the positions of valves A–C to their original starting positions.

It will be appreciated by those knowledgeable in this art that the actuator 10 offers many advantages in construction in that the relative sizes of the various parts may be changed to accomplish various and different output forces dependent upon the requirements of the device, machine, or mechanism which is attached to the output of the actuator. For example, the relative diameters of the pistons 32 and 62 may be varied as well as the relative diameters of the shafts or cylinders 34 and 64 and this will vary the volume capacities of the pressure chambers 40, 42, 50, and 52. In addition, the input fluid passages 90, 100, and 110 may be varied as well as the capacities of the valves A–C and this may be coupled with varied hydraulic fluid pressures HP1, HP2, and/or HP3. In addition it will be recognized that the dimensions and wall thicknesses of the various members which comprise the actuator 10 may be varied to accomodate the hydraulic pressures which may be expected for different and various type applications of the actuator. These type changes and/or modifications of the actuator are anticipated and considered to be within the scope of the present invention.

Figure 2:
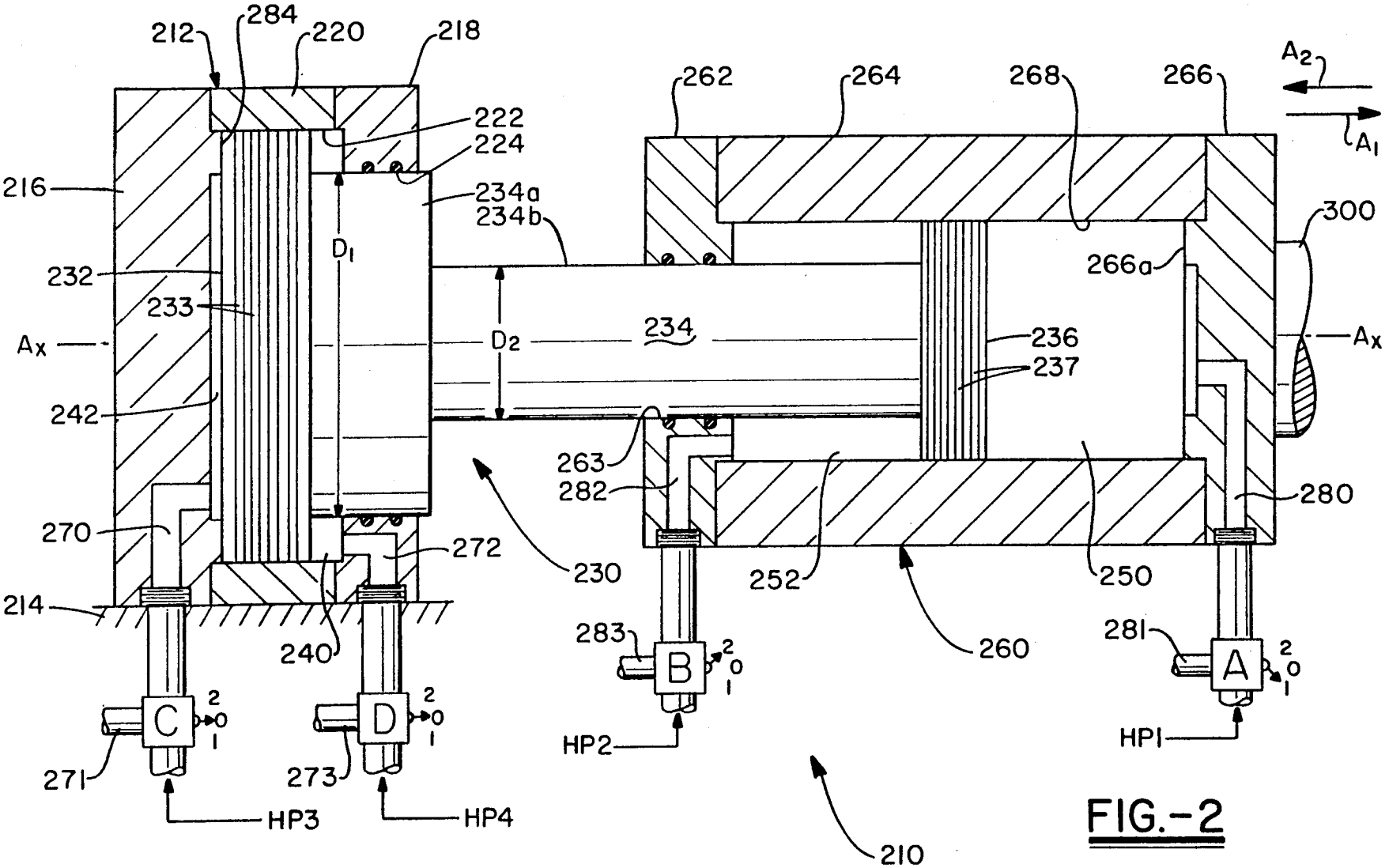
FIG. 2 is an elevational view, in partial cross-section, of a hydraulic actuator in accordance with a second embodiment of the invention.
Figure 3:
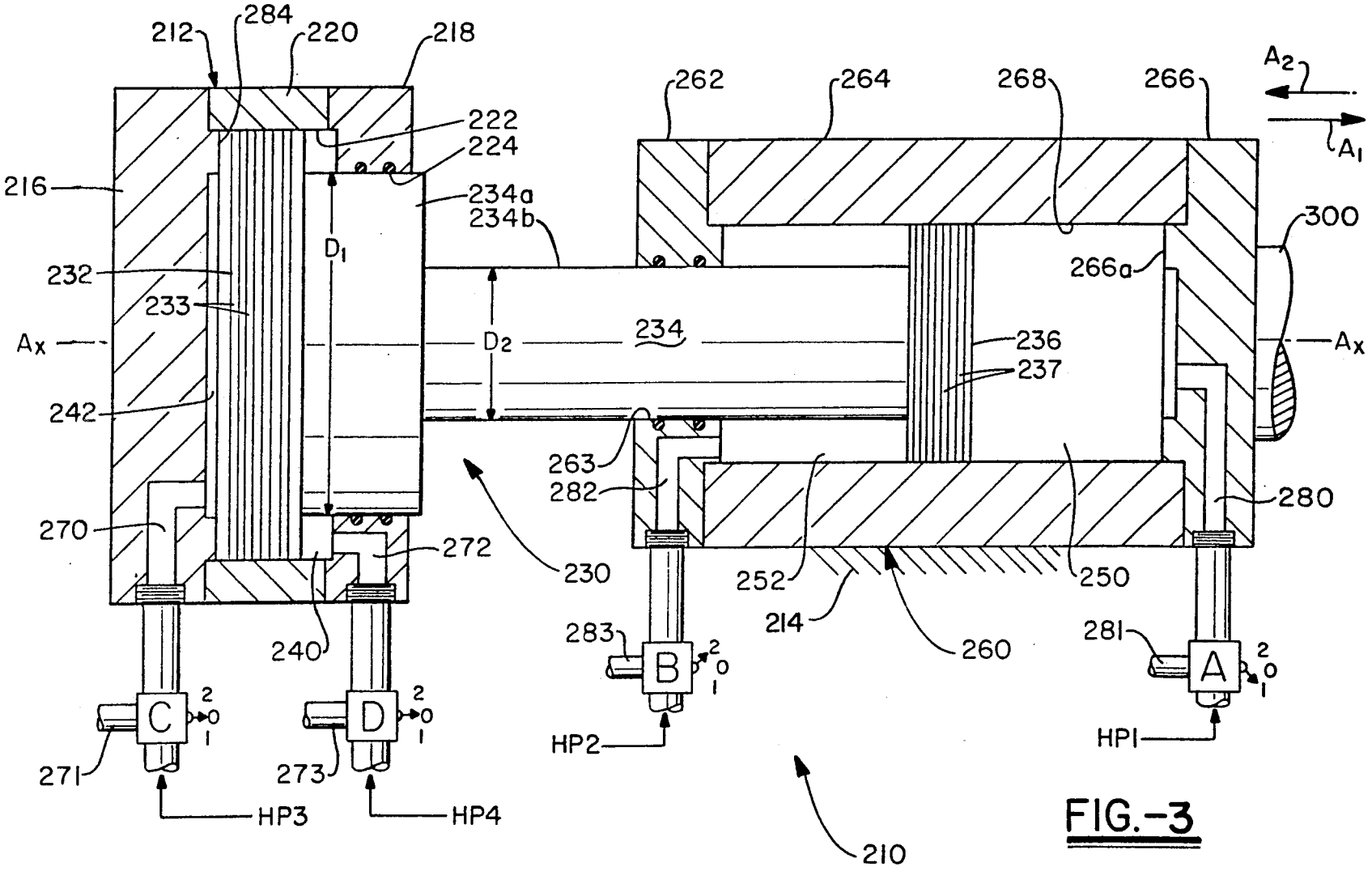
FIG. 3 is an elevational view, in partial cross-section, of a hydraulic actuator which is identical to the actuator shown in FIG. 2 except that the fixed and movable ends of the actuator are opposite to those of the actuator in FIG. 2.

Referring to FIG. 2 of the drawings, reference numeral 210 generally indicates a hydraulic actuator according to a second embodiment of the invention wherein a housing 212 is mounted at 214 such as to be relatively stationary with reference to an output end which may be to the right as shown at reference numeral 300. As described with respect to the actuator 10 of FIG. 1, the actuator 210 may be applied to any type of device, machine, or mechanism which may be moving or stationary and for the purposes of this description the housing 212 will be considered stationary irrespective of whether or not the mounting at 214 is moving or stationary. Furthermore, the alternative mounting arrangement may be applied to the actuator 210 wherein the end 300 may be made stationary with reference to the housing 212 as shown in FIG. 3, by mounting the cylinder assembly 206 at 214 which housing 212 then becomes the dedicated movable member for producing an output which is accepted by a device which is affixed to the housing 212. This description, however, will be directed to the prior configuration, i.e., the housing 212 is mounted stationary with respect to a relatively output end 300.

In any event, the actuator 210 is configured to functionally carry a pair of hydraulic cylinder assemblies which are generally indicated at reference numerals 230 and 260 respectively and these are mounted coaxially with respect to a longitudinal axis indicated at Ax—Ax in the drawing.

The housing 212 has an input end member 216 and an output end member 218 and these are interconnected by a middle shaft or cylinder member 220 which defines a bore 222. The bore 222 is adapted for receiving a piston 232 of assembly 230 in a working fit relationship such that the piston moves within the bore along the Ax axis. The output member 218 has a longitudinal bore 224 through which a shaft member 234 of the assembly 230 passes in a sliding relationship and it also provides a stop for the piston 232 should it traverse the full longitudinal length of the bore 222.

The assembly 230 is comprised of a first piston 232 which is connected to a second piston 236 through a shaft member 234, the shaft member 234 having a first shaft portion 234*a* connected to the first piston 232 and a second shaft portion 234*b* connected to the piston 236. The first shaft portion 234*a* has a larger diameter D1 than the second shaft portion which has a diameter D2. The shaft diameters 234*a* and 234*b* establish the volume capacities of pressure chambers of the actuator 210 and this will be apparent as this description proceeds. The piston 232 is in sealed engagement within the bore 222 via a plurality of seal rings 233 in a conventional manner and the piston 236 is in sealed engagement within the assembly 260 via a plurality of seal rings 237 also in the conventional manner.

The assembly 260 comprises a cylinder housing having an end member 262 which has an axial bore 263 through which the shaft member 234 of the assembly 230 passes in a sliding engagement. The member 262 is connected to an output member 266 through a middle shaft or cylinder member 264 which defines a bore 268. The bore 268 is adapted for receiving the piston 236 of the assembly 230 in a working fit relationship such that the assembly 260 and piston 236 exhibit relative motion between them along the Ax axis. The output end member 266 may be connected to another shaft member 300 which will function to transfer the output workforce of the actuator to another device, machine, or mechanism (not shown) which requires such action for its operation. In similar manner to the embodiment of FIG. 1, the actuator output may be with respect to the end member 216 while the end member 266 of assembly 260 may be rendered stationary. This description will be with respect to the prior configuration recognizing that either arrangement made be made to accomplish the results of the actuator 210.

It should be evident from the foregoing description and the drawing that the relationship of the assembly 230 and the bore 222 is such as to define a forward pressure chamber 240 and a rearward pressure chamber 242 with respect to the piston 232 when the direction of the output is according to reference arrow A1. Similarly, the relationship of the piston 236 and the bore 268 is such as to define a forward pressure chamber 250 and a rearward pressure chamber 252 and, again, when the output is directed in the direction of arrow A1.

In the operation of the actuator 210, hydraulic fluid pressure is introduced into the pressure chambers 240, 242, 250, and 252 by way of a plurality of control valves which are only schematically illustrated at references A, B, C, and D in the drawing. The valves A--D may be similar in operation to the valves A-C of the FIG. 1 embodiment and the valve positions are indicated at "0", "1", and "2" associated with each of the valves. In this respect, valve A is adapted for passing a hydraulic fluid pressure HP1 into pressure chamber 250 via a fluid passage 280 and for exhausting fluid pressure via an output line 281 which connects to a suitable sump or reservoir. Valve B is also adapted for passing a hydraulic fluid pressure HP2 into pressure chamber 252 via a fluid passage 282 in the end member 262 of assembly 260 and for exhausting fluid pressure via an output line 233 which connects to a sump or reservoir in a conventional manner. Valve C also is adapted for passing a hydraulic fluid pressure HP3 into pressure chamber 242 via a passage 270 in end member 216 and for exhausting fluid pressure via an output line 271 which connects to a sump or reservoir. Valve D is adapted for passing a hydraulic fluid pressure HP4 into pressure chamber 240 via a fluid passage 272 in the end member 218 and for exhausting fluid, pressure via an output line 273 which is connected to a suitable sump or reservoir. As already mentioned with respect to the embodiment 10 of FIG. 1, various well-known combinations of hydraulic fluid pumps, reservoirs, and valve controls may be applied to the actuators 10 or 210 and the invention is not considered limited to a particular configuration which may be suggested from the drawing, In the operation of the actuator 210, it will be assumed that the assemblies 230 and 260 initiate action from a home position which is at the left in the drawing and that work output is exerted to the right, i.e., in the direction of reference arrow A1. Reverse actuator action, of course, will be to the left in the direction of reference arrow A2. In the drawing, assembly 230 is shown at the home position while assembly 260 is shown in a position moved to the right from its home position and this is done for the sole purpose of the illustration and is not intended to be confusing. The home position for cylinder assembly 260 is when the piston 236 of assembly 230 is in abutting relationship with the inside surface of the output end member 266 where an annular seat 266*a* may be provided for engagement with the piston 236 when it is at the home position. Of course, the annular seat 266*a* may be a separate annular ring fitted within the bore 268 or it may comprise part and parcel of the end member 266 as shown in the drawing. Alternatively, the seat 266*a* may be formed on the end surface of the piston 236.

To begin operation, valve A is placed in the "1" position such as to pass hydraulic fluid pressure HP1 while valve B is placed in the "2" position to exhaust fluid pressure. The valves C and D are placed in the "0" position which maintains assembly 230 at the home position shown. The introduction of hydraulic fluid pressure HP1 into pressure chamber 250 effects a pressure force on piston 236 which moves cylinder assembly 260 to the right and a work output force may be applied to a device affixed to shaft 300 and in the direction of arrow A1. This is a relatively fast forward motion of assembly 260 as this may be determined by the surface area of piston 236 and the hydraulic fluid pressure and volume of HP1. When the output stroke of assembly 260 reaches its termination, valves A and B are switched to the "0" position which locks assembly 260 relative to assembly 230. Valve D is then switched to the "2" position for exhausting pressure and valve C is switched to the "1 " position for introducing hydraulic fluid pressure HP3 into pressure chamber 242. This effects a very high output force from assembly 230 which may be predetermined by the relative size of piston 232 and hydraulic fluid pressure HP3 and this force is transferred to assembly 260 which is locked by the positions of valves A and B. It should be noted that this embodiment of the invention lends well to injection molding processes wherein a fast forward stroke for mold closure is desired and this is followed by a very high and stable force which maintains mold closure during the injection molding operation.

The reverse operation of actuator 210 is accomplished by switching valve C to the "2" position for exhausting fluid pressure from chamber 242 and switching valve D to the "1" position for passing hydraulic fluid pressure HP4 into pressure chamber 240 to move assembly 230 back to the home or starting position. Concurrently or, in following sequence, valve A is switched to the "2" position for exhausting fluid pressure and valve B is switched to the "1" position for passing hydraulic fluid pressure HP2 into pressure chamber 252 to effect a movement of assembly 260 in the direction of arrow A2 toward the home position at annular seat 266*a*. A work cycle of the actuator 210 is completed and it is ready to initiate another cycle upon switching of the appropriate valves A–D.

Finally with reference to FIG. 2, it should be noted that an annular seat 284 may be provided within the bore 222 to effect a seating engagement with the piston 232 when it is at the home positon shown in the drawing. The annular seat 284 may be a seperate ring or be part of the housing 216 as illustrated or be part of the piston 232. The manner of providing such an annular seat is at the discretion of the designer and not a limiting factor of this invention. In addition, it should be noted in the drawing that the bores 224 and 263 in end members 218 and 262 respectively are in sealed engagement with shaft portions 234*a* and 234*b* by way of a plurality of seal rings mounted within the bores. Such seals are also shown in the FIG. 1 embodiment within the bores 24 and 35. Such type sealing of bores and shafts which slide therethrough is considered conventional and well within the knowledge and skill of persons working in this art to provide.

While certain representative embodiments and details have been shown for the purpose of illustrating the present invention, it will be apparent to those skilled in this art that various changes and/or modifications may be made thereto without departing from the spirit or scope of the invention as it is claimed.

What is claimed is:

1. A hydraulic fluid pressure operated actuator for supplying a fast forward output stroke followed by an increased pressure force of the output comprises in combination:

a housing which defines a cylinder bore and pressure chamber;

a first assembly having a piston carried coaxially for motion within the housing bore, said piston defining forward and rearward pressure chambers and exhibiting the reciprocal motion dependent upon a selective hydraulic fluid pressurization of the pressure chambers, said assembly having a shaft extending from the housing which itself defines a coaxial bore and pressure chamber;

a second assembly having a piston carried coaxially for motion within the shaft bore of the first assembly, said piston defining forward and rearward pressure chambers and exhibiting reciprocal motion dependent upon a selective hydraulic fluid pressurization of the pressure chambers, said piston having a shaft extending outwardly from the assembly;

a check valve mounting coaxially to the piston of the first assembly and adapted for passing the hydraulic fluid pressure from the rearward pressure chamber of the first assembly to the rearward pressure chamber of the second assembly, said check valve being biased in an open position to pass hydraulic fluid pressure for a fast forward output stroke and which closes to block hydraulic fluid pressure for a high force output; and means to supply, exhaust, and control hydraulic fluid pressure to and from the forward pressure chambers of the first and second assemblies and from the rearward pressure chamber of the first assembly such that the piston of the second assembly is moved fast forwardly when the check valve is open and hydraulic fluid pressure is applied to the rearward pressure chambers of the first and second assemblies and upon a completion of the fast forward stroke, the piston of the first assembly is caused to move by releasing hydraulic fluid in the forward chamber of the first assembly to provide a high force output upon closure of the check valve.

2. The actuator as claimed in claim 1 wherein the housing is mounted to be relatively stationary with respect to the shaft which extends from the second assembly, said shaft comprising the output of the actuator.

3. The actuator as claimed in claim 1 wherein the shaft which extends from the second assembly is mounted to be relatively stationary with respect to the housing, said housing comprising the output of the actuator.

4. The actuator as claimed in claim 1 wherein the piston of the first assembly has a plurality of axial fluid passage bores through it which communicate hydraulic fluid pressure from the rearward pressure chamber of the first assembly to the rearward pressure chamber of the second assembly; and the cheek valve comprises a valve disk positioned within the rearward pressure chamber of the second assembly and connected to a valve stop positioned within the rearward pressure chamber of the first assembly through a valve stem which passes through an axial bore in the piston, said valve stem adapted for carrying a compression spring which is compressed for the fast forward stroke of the output and which expands to close off the axial fluid passage bores by way of the valve disk during the high force portion of the output stroke.

5. The actuator as claimed in claim 4 wherein the valve disk closes off the fluid passage bores upon the piston of the first assembly being moved a predetermined axial distance.

6. A hydraulic fluid pressure operated actuator for supplying an initial fast output stroke to cause rapid elongation of the actuator from a retracted position sequentially followed by an additional output stroke to cause further elongation of the actuator to an extended position and to provide an increased high pressure force output, said actuator having a fixed end and a moveable end, the actuator comprising:

a large diameter cylinder having an axial bore therein of relatively short axial length;

a large diameter piston carried coaxially within the bore of the large diameter cylinder and defining axially inwardly and outwardly positioned pressure chambers and being capable of a relatively short axial distance of reciprocal travel dependent upon a selective pressurization of the pressure chambers;

a smaller diameter cylinder having an axial bore therein of substantially greater axial length than the bore of the large diameter cylinder;

the axial bores of both the large diameter cylinder and the smaller diameter cylinder being in axial alignment with each other;

a smaller diameter piston carried coaxially within the bore of the smaller diameter cylinder and defining axially inwardly and outwardly positioned pressure chambers, said piston being capable of a substantially greater axial distance of reciprocal travel than the large piston, dependent upon a selective pressurization of the pressure chambers within the smaller diameter piston;

a connecting piston rod having one of its ends fixedly attached to the large diameter piston and its other end fixedly attached to the smaller diameter piston, said piston rod being in axial alignment with both cylinders so that any axial movement of either piston will also cause the other piston to move the same axial distance;

means sequentially pressurizing first the axially outwardly positioned chamber of the smaller diameter cylinder to cause fast relative movement between the smaller diameter cylinder and the smaller diameter piston therein to effect rapid axial elongation of the actuator; and means thereafter pressurizing the axially outwardly positioned chamber of the large diameter cylinder to cause relative movement between the large diameter cylinder and the large diameter piston therein to effect further elongation of the actuator and produce a high pressure output force at the moveable end of the actuator while simultaneously maintaining pressure in the axially outwardly positioned chamber of the smaller diameter cylinder to restrict relative movement between the smaller diameter cylinder and the smaller diameter piston therein.

7. The actuator as claimed in claim 6 wherein the large diameter cylinder constitutes the fixed end of the actuator and the smaller diameter cylinder constitutes the moveable end of the actuator.

8. The actuator as claimed in claim 6 wherein the large diameter cylinder constitutes the moveable end of the actuator and the smaller diameter cylinder constitutes the fixed end of the actuator.

9. The actuator as claimed in claim 6 wherein the actuator is adapted to provide a sequence of actuation steps in which the smaller diameter piston is first held by the piston rod and the large diameter piston in a fixed axial position with respect to the large diameter cylinder, and the small diameter cylinder is moved axially with respect to the small diameter piston and the rest of the actuator to rapidly elongate the actuator, and thereafter, the piston rod with both pistons and the smaller diameter cylinder are all moved together a further axial distance with respect to the large diameter cylinder to further elongate the actuator while providing a high pressure output from the smaller diameter cylinder.

10. The actuator as claimed in claim 6 wherein the actuator is adapted to provide a sequence of actuation steps in which the smaller diameter cylinder is first held in a fixed position and the rest of the actuator is moved axially with respect to the smaller diameter cylinder to rapidly elongate the actuator, and thereafter, the large diameter cylinder is moved axially with respect to the rest of the actuator to further elongate the actuator while providing a high pressure output from the large diameter cylinder.

11. The actuator as claimed in claim 6 wherein the means pressurizing the axially outer chamber of the large diameter cylinder is a first hydraulic pressure line connected through a first control valve and the means pressurizing the axially outer chamber of the smaller diameter cylinder is a second hydraulic pressure line connected through a second control valve.

12. The actuator as claimed in claim 6 including means to pressurize the axially inwardly positioned chambers of both the large diameter cylinder and the smaller diameter cylinder and to exhaust pressure from the axially outwardly positioned chamber of both the large diameter cylinder and the smaller diameter cylinder to return the actuator from the extended position to the retracted position.

13. A hydraulic fluid pressure operated actuator for supplying an initial fast output stroke to cause rapid elongation of the actuator from a retracted position sequentially followed by an additional output stroke to cause further elongation of the actuator to an extended position and to provide an increased high pressure force output, said actuator having a fixed end and a moveable end, the actuator comprising:

a first cylinder having an axial bore and a first piston therein, said first cylinder having a open end and a closed end;

a second cylinder having an axial bore and a second piston therein, said second cylinder having an open end and a closed end;

the first and second cylinders being coaxial with each other and having their open ends facing axially inwardly toward each other;

a piston rod extending through the open end of each cylinder in sealing engagement therewith and having one axial end fixedly attached to the first piston and the opposite end fixedly attached to the second piston so that axial movement of either piston will cause the same amount of axial movement of the other piston;

both the first and second pistons dividing the bore of the respective cylinder in which it is located into an axially inwardly positioned chamber and an axially outwardly positioned chamber;

means to sequentially regulate the flow of hydraulic fluid into and out of the chambers of the first cylinder to first establish a sufficient pressure differential between the chambers of the first cylinder to cause rapid relative movement between the first piston and the first cylinder and thereby cause a rapid primary axial elongation of the actuator; and means to sequentially regulate the flow of hydraulic fluid into and out of the chambers of the second cylinder to secondly establish a sufficient pressure differential between the chambers of the second cylinder to cause relative movement between the second piston and the second cylinder and thereby cause a secondary additional axial elongation of the actuator, while maintaining pressure differential in the chambers of the first cylinder to retain the primary axial elongation of the actuator;

the second cylinder and second piston being adapted to produce a high pressure output at the moveable end of the actuator as the secondary elongation of the actuator occurs, by transmitting high pressure force to the first cylinder through the second piston, the piston rod, the first piston, and through hydraulic fluid trapped in the first cylinder.

14. The actuator as claimed in claim 13 wherein the second cylinder constitutes the fixed end of the actuator and the first cylinder constitutes the moveable end of the actuator.

15. The actuator as claimed in claim 13 wherein the first cylinder constitutes the fixed end of the actuator and the second cylinder constitutes the moveable end of the actuator.

* * * * *